US010688781B2

(12) United States Patent
Arakane et al.

(10) Patent No.: US 10,688,781 B2
(45) Date of Patent: Jun. 23, 2020

(54) PRINTING APPARATUS

(71) Applicant: BROTHER KOGYO KABUSHIKI KAISHA, Nagoya-shi, Aichi-ken (JP)

(72) Inventors: Satoru Arakane, Nagoya (JP); Yusuke Arai, Nagoya (JP); Masayoshi Hayashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/296,575

(22) Filed: Mar. 8, 2019

(65) Prior Publication Data

US 2019/0283399 A1 Sep. 19, 2019

(30) Foreign Application Priority Data

Mar. 14, 2018 (JP) ..... 2018-046538

(51) Int. Cl.
*B41J 2/045* (2006.01)
*B41J 25/00* (2006.01)
*B41J 11/00* (2006.01)

(52) U.S. Cl.
CPC ..... *B41J 2/04508* (2013.01); *B41J 2/04586* (2013.01); *B41J 11/0095* (2013.01); *B41J 25/006* (2013.01)

(58) Field of Classification Search
CPC ..... B41J 2/04508; B41J 11/0095; B41J 2/04586; B41J 25/006
See application file for complete search history.

(56) References Cited

U.S. PATENT DOCUMENTS 6,471,315 B1 * 10/2002 Kurata ..... B41J 2/04505 347/16
2006/0221111 A1 * 10/2006 Ouchi ..... B41J 11/003 347/16
2008/0145123 A1 * 6/2008 Kogure ..... B41J 11/007 399/395
2011/0227979 A1 9/2011 Morishita
2012/0081448 A1 * 4/2012 Endo ..... B41J 11/008 347/16

FOREIGN PATENT DOCUMENTS

JP 2005-060007 A 3/2005
JP 2008-006793 A 1/2008
JP 2011-189712 A 9/2011

* cited by examiner

*Primary Examiner* — Sharon A. Polk
(74) *Attorney, Agent, or Firm* — Scully, Scott, Murphy & Presser, PPC

(57) ABSTRACT

There is provided a printing apparatus including: a platen; a head; a carriage moving in a first direction and a second direction; a sensor configured to detect the medium; a memory; and a controller. Before a certain printing pass starts, the controller is configured to get a first distance value in the first direction between the sensor and a most downstream nozzle and a second distance value between an end of the medium and a close landing position that is closest to the end of the medium. The controller is configured to continue the certain printing pass without stopping the movement of the carriage, when the controller has determined that the second distance value is larger than the first distance value, and when the controller has determined that the medium is supported by the platen.

10 Claims, 8 Drawing Sheets

PRINTING APPARATUS

CROSS REFERENCE TO RELATED APPLICATION

The present application claims priority from Japanese Patent Application No. 2018-046538 filed on Mar. 14, 2018, the disclosure of which is incorporated herein by reference in its entirety.

BACKGROUND

Field of the Invention

The present disclosure relates to a printing apparatus configured to perform printing on a medium by discharging liquid droplets from nozzles.

Description of the Related Art

There is a printing apparatus that performs printing in a predefined area of a medium by performing one scan (one pass) of a carriage carrying a head. Further, there is a printing apparatus including a sensor carried on a carriage. The sensor detects whether a medium is on a platen facing a head.

Conventionally, the sensor detects whether a medium is present after the carriage moves to a position where the sensor faces the platen. When the sensor has detected that the medium is on the platen, the carriage moves to the outside in a scanning direction of the platen and positioned there temporarily. Then, a printing pass (scan) is started by moving the carriage toward the platen in the scanning direction. That configuration needs movement of the carriage for allowing the sensor to detect the medium and movement of the carriage for retreating itself to the outside in the scanning direction of the platen, resulting in a long time until the printing pass starts.

In order to shorten the time until the printing pass starts, a printing apparatus including a sensor that is disposed at a portion extending leftward from a head is publicly known. In that configuration, when the head is positioned at a predefined position on the right of a medium and when the carriage moves leftward from that position, the sensor reaches a position immediately above the medium earlier than nozzles of the head. Thus, after the sensor executes detection of the medium, printing can start by moving the carriage leftward directly.

SUMMARY

When the head of the above printing apparatus is positioned on the left of the medium and when the carriage moves rightward from that position, nozzles of the head reach the position immediately above the medium earlier than the sensor. In that case, before the printing pass starts, the carriage needs to return to the predefined position, resulting in a long time until the printing pass starts.

The same problem occurs when the sensor is attached on the right of the head. In that configuration, when the head is positioned on the right of the medium and when the carriage moves leftward from that position, nozzles of the head reach a position immediately above the medium earlier than the sensor. This results in a long time until the printing pass starts, similarly to the above.

The present disclosure is made in view of the above circumstances, and an object of the present disclosure is to provide a printing apparatus that is capable of shortening a time until a printing pass starts, even when movement of a carriage makes nozzles of a head reach a position immediately above a medium earlier than a sensor.

According to an aspect of the present disclosure, there is provided a printing apparatus, including: a platen configured to support a medium; a head having a nozzle surface in which a plurality of nozzles are opened; a carriage carrying the head and configured to move along the nozzle surface in a first direction and a second direction, which is opposite to the first direction, so that the nozzle surface faces the platen; a sensor carried on the carriage at a position in the first direction between the head and an end in the first direction of the carriage where the sensor is capable of facing the platen and the medium supported by the platen, and configured to detect the medium; a memory configured to store distance information about a distance in the first direction between the nozzles and the sensor; and a controller configured to control, based on printing data, the head and the carriage to execute a printing pass in which liquid droplets are discharged from the nozzles to the medium supported by the platen during movement of the carriage. Before a certain printing pass, which is the printing pass corresponding to one pass to be executed, starts, the controller is configured to obtain, based on the printing data and the distance information, a first distance value in the first direction between the sensor and a most downstream nozzle of the nozzles to be used in the certain printing pass and positioned at a most downstream side in a case that the carriage moves in one of the first direction and the second direction, the controller is configured to obtain, based on the printing data, a second distance value in the first direction between an end of the medium and a close landing position, the end of the medium being an end which is included in ends in the first direction of the medium and above which the most downstream nozzle passes first in the certain printing pass, the close landing position being a position which is included in landing positions on which liquid droplets land from the most downstream nozzle and is closest to the end in the first direction of the medium, and the controller is configured to continue the certain printing pass without stopping the movement of the carriage, in a case that the controller has determined that the second distance value is larger than the first distance value, and in a case that the controller has determined, based on an output result of the sensor, that the medium is supported by the platen in a case that the carriage moves in one of the first direction and the second direction to start the certain printing pass.

In the above configuration, the controller detects whether the medium is supported by the platen during movement of the carriage in the printing pass corresponding to one pass. This shortens the time until the printing pass starts.

When the second distance value is equal to or less than the first distance value, and when the controller executes detection of the medium during the movement of the carriage in the printing pass corresponding to one pass, liquid droplets may be discharged from nozzles before the controller detects whether the medium is supported by the platen. When no medium is supported by the platen, the liquid droplets adhere to the platen. In order to prevent that problem, in the above configuration, after determining that the second distance value is larger than the first distance value, the controller detects whether the medium is supported by the platen during the movement of the carriage in the printing pass corresponding to one pass. Thus, it is possible to prevent the liquid droplets from adhering to the platen.

According to the present disclosure, the time until the printing pass starts can be shortened even when movement of the carriage makes nozzles of the head reach a position immediately above the medium earlier than the sensor.

DESCRIPTION OF THE EMBODIMENTS

Figure 1:
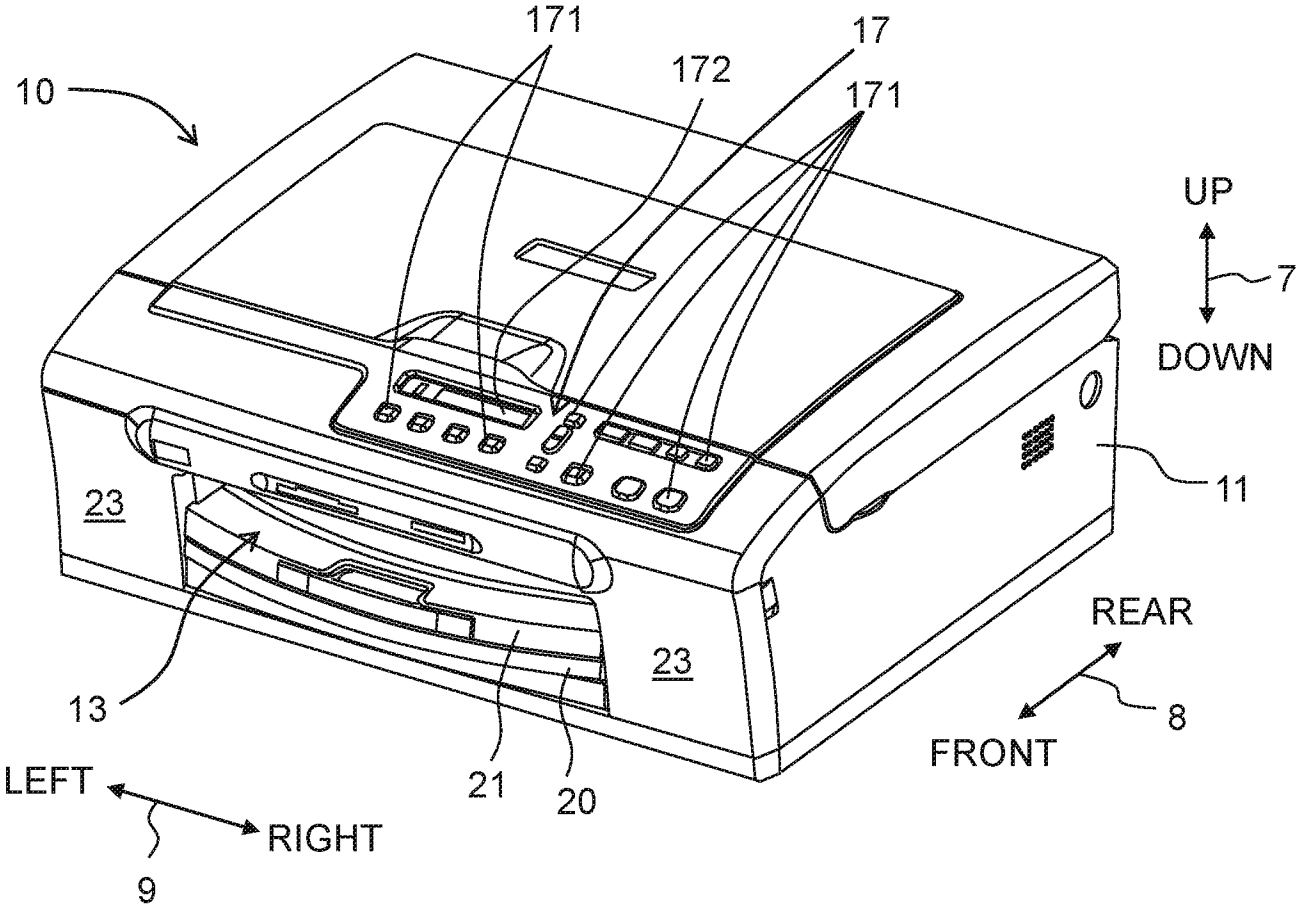
FIG. 1 is a perspective view of a multifunction peripheral 10.

Embodiments described below are merely examples of the present disclosure, and it goes without saying that the embodiments of the present disclosure may be appropriately changed in a range that does not alter the gist or essential characteristics of the present disclosure. In the following explanation, an up-down direction 7 is defined based on a state in which the multifunction peripheral 10 is disposed to be usable (the state depicted in FIG. 1). A front-rear direction 8 is defined as an opening 13 is provided in a front surface 23 of the multifunction peripheral 10. A left-right direction 9 is defined as the multifunction peripheral 10 is seen from the front side. The up-down direction 7 is perpendicular to the front-rear direction 8 and the left-right direction 9, and the front-rear direction 8 is orthogonal to the left-right direction 9.

Configuration of Multifunction Peripheral 10

As depicted in FIG. 1, the multifunction peripheral 10 (an exemplary printing apparatus) has roughly a rectangular parallelepiped shape. A printer unit 11 is provided at a lower portion of the multifunction peripheral 10. The multifunction peripheral 10 has different kinds of functions, such as a facsimile function and a printing function. The multifunction peripheral 10 uses the printing function to perform printing (image recording) on a surface of a sheet 12 (see FIG. 2, an exemplary medium) by an ink-jet system. The multifunction peripheral 10 may perform printing on both surfaces of the sheet 12. An operation unit 17 is disposed at an upper portion of the printer unit 11. The operation unit 17 includes buttons 171 through which a printing command and different kinds of settings are input, a liquid crystal display 172 on which different kinds of information is displayed, and the like.

Figure 2:
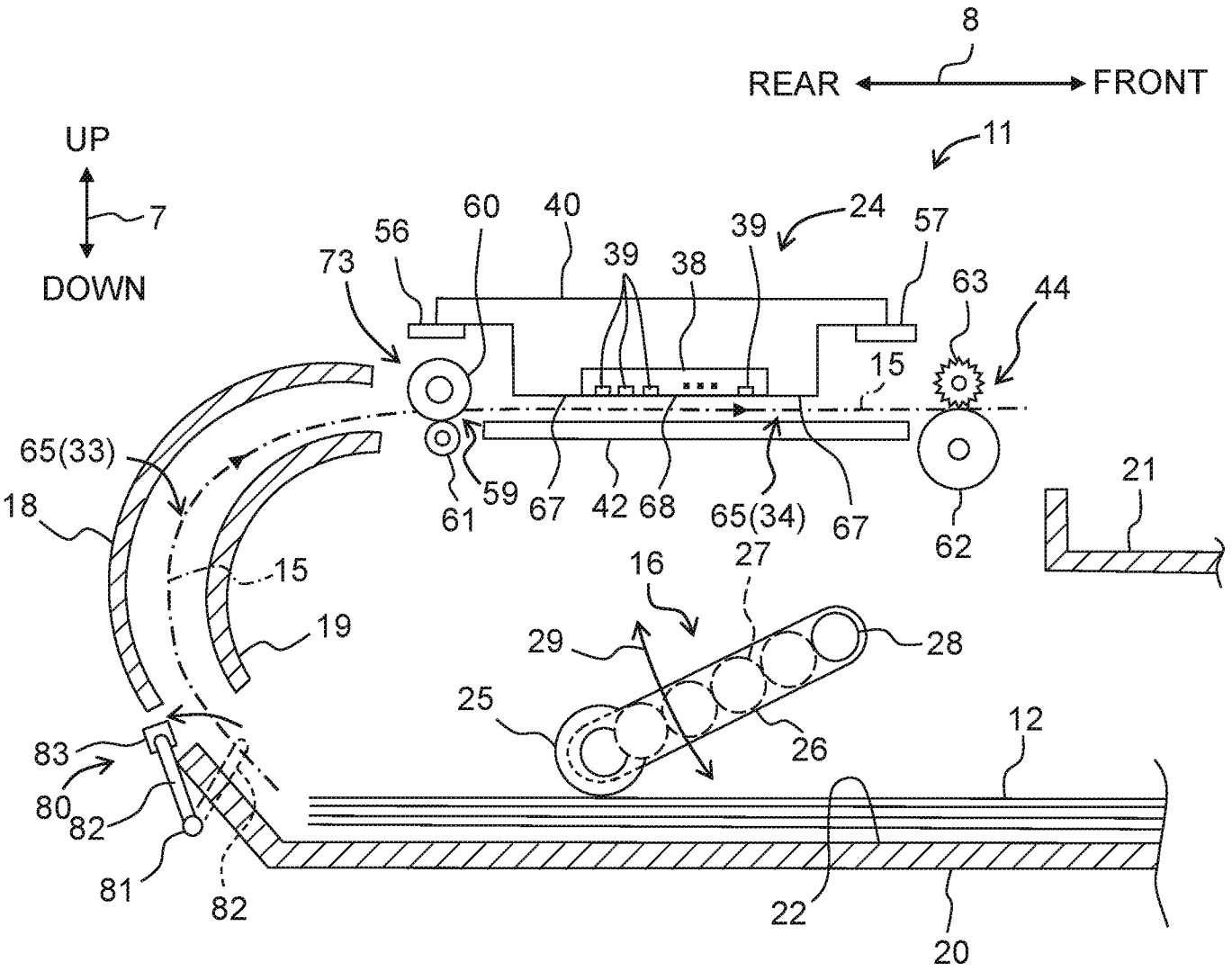
FIG. 2 is a longitudinal cross-sectional view schematically depicting an internal structure of a printer unit 11.
Figure 4:
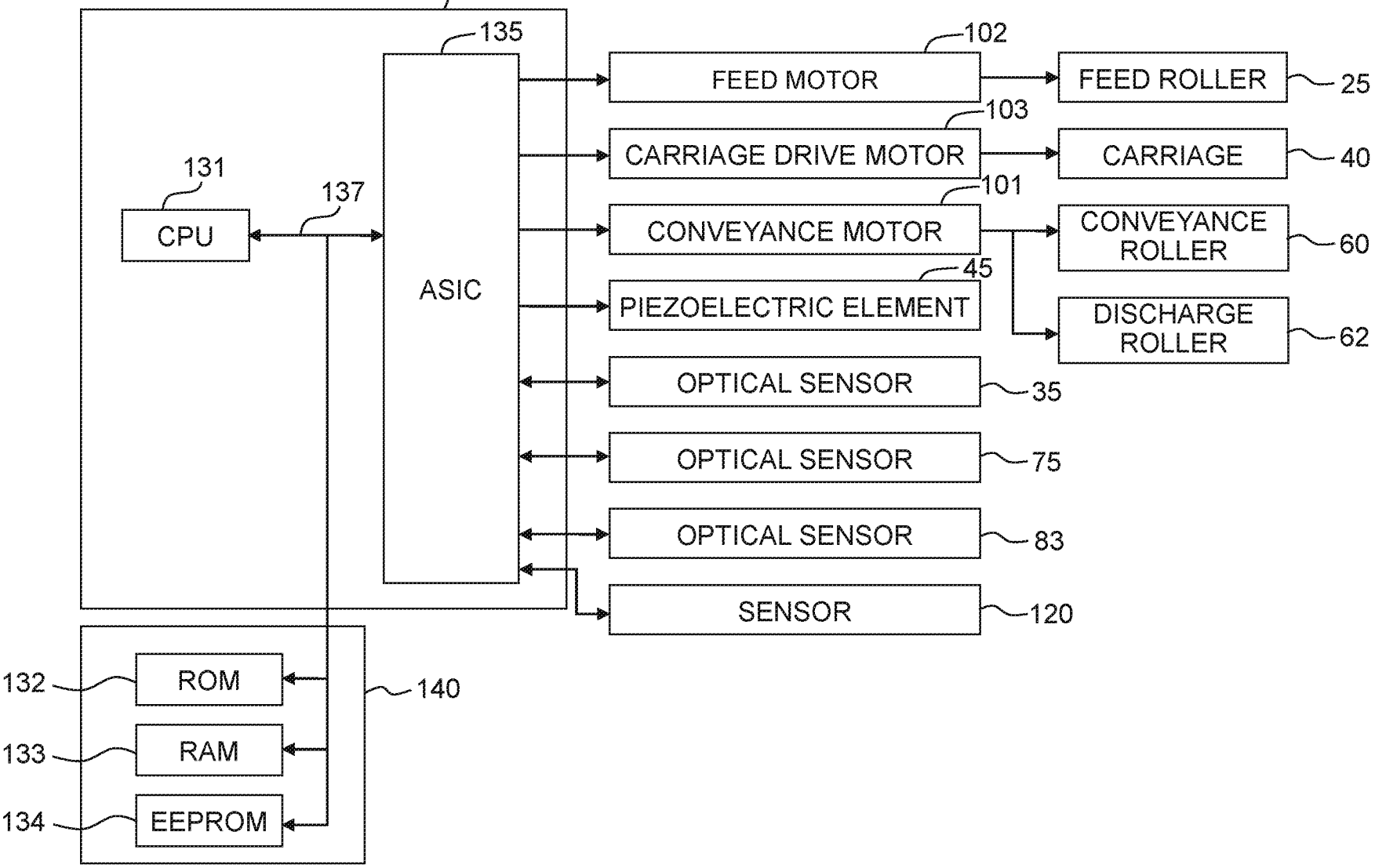
FIG. 4 is a block diagram depicting a configuration that includes a controller 130 and a memory 140.

As depicted in FIG. 2, the printer unit 11 includes a feed tray 20, an installation sensor 80, a feed unit 16, an outer guide member 18, an inner guide member 19, a platen 42, a recording unit 24, a conveyance roller pair 59, a discharge roller pair 44, a rotary encoder (not depicted), a controller 130 (see FIG. 4), and a memory 140 (see FIG. 4).

Feed Tray 20

As depicted in FIG. 1, the opening 13 is formed in the front surface 23 of the printer unit 11. The feed tray 20 is inserted into or removed from the printer unit 11 via the opening 13 by moving in the front-rear direction 8. The feed tray 20, which stores sheets 12, is a box-like member of which upper side is open. As depicted in FIG. 2, sheets 12 stacked on top with each other are supported by a bottom plate 22 of the feed tray 20. A discharge tray 21 is disposed above a front portion of the feed tray 20. The sheet 12 for which printing is performed by the recording unit 24 is discharged on an upper surface of discharge tray 21 so that the sheet 12 discharged is supported thereby.

Installation Sensor 80

The installation sensor 80 depicted in FIG. 2 determines whether the feed tray 20 is inserted to the far side of the printer unit 11. Namely, the installation sensor 80 determines whether the feed tray 20 is installed in the printer unit 11.

As depicted in FIG. 2, the installation sensor 80 is provided on the rear side of the feed tray 20. The installation sensor 80 includes a shaft 81 that is supported by a frame (not depicted) of the printer unit 11, a detector 82 that is capable of pivoting around the shaft 81, and an optical sensor 83 that includes a light emitting element and a light receiving element for receiving light emitted from the light emitting element.

When the feed tray 20 is not inserted to the far side of the printer unit 11, the detector 82 is urged frontward by an unillustrated urging member (e.g., a coil spring). This makes the detector 82 into a state depicted by broken lines in FIG. 2. In that situation, an optical path ranging from the light emitting element to the light receiving element of the optical sensor 83 is not blocked, and thus the optical sensor 83 outputs a high-level (a level higher than a preset threshold value) electrical signal to the controller 130 (see FIG. 4).

During an insertion process of the feed tray 20 to the far side of the printer unit 11, the detector 82 is pushed by the feed tray 20 to pivot rearward against the urging force of the urging member. The detector 82 is in a position depicted by solid lines in FIG. 2 in a state where the feed tray 20 is inserted to the far side of the printer unit 11. In that case, the optical path ranging from the light emitting element to the light receiving element of the optical sensor 83 is blocked, and thus the optical sensor 83 outputs a low-level (a level smaller than the preset threshold value) electrical signal to the controller 130 (see FIG. 4).

Unlike the above configuration, the optical sensor 83 may output the low-level electrical signal in the state where the feed tray 20 is not inserted to the far side of the printer unit 11, and the optical sensor 83 may output the high-level electrical signal in the state where the feed tray 20 is inserted to the far side of the printer unit 11. The optical sensor 83 may be configured to output no electrical signal instead of outputting the low-level electrical signal. The configuration of the installation sensor 80 is not limited to the above configuration, and any other publicly-known configuration may be adopted.

Feed Unit 16

As depicted in FIG. 2, the feed unit 16 is disposed below the recording unit 24 and above the bottom plate 22 of the feed tray 20. The feed unit 16 includes a feed roller 25, a feed arm 26, a drive transmission mechanism 27, and a shaft 28. The feed roller 25 is rotatably supported by a front end of the feed arm 26. The feed arm 26 pivots in directions indicated by an arrow 29 around the shaft 28 provided in a base end of the feed arm 26. This allows the feed roller 25 to come into contact with and separate from the feed tray 20 or the sheet 12 supported by the feed tray 20.

The drive transmission mechanism 27 including gears meshing with each other transmits driving force of a feed motor 102 (see FIG. 4) to the feed roller 25, which rotates the feed roller 25. Rotation of the feed roller 25 feeds an uppermost sheet 12, which is included in sheets 12 supported by the bottom plate 22 of the feed tray 20 and is brought into contact with the feed roller 25, to the conveyance path 65. The drive transmission mechanism 27 is not limited to the configuration including the gears meshing with each other. The drive transmission mechanism 27 may be, for example, a belt stretched between the shaft 28 and a shaft of the feed roller 25.

Conveyance Path 65

As depicted in FIG. 2, the conveyance path 65 extends from a rear end of the feed tray 20. The conveyance path 65 includes a curved portion 33 and a straight portion 34. The curved portion 33 makes a U-turn frontwardly while extending from the lower side to the upper side. The straight portion 34 extends roughly in the front-rear direction 8.

The curved portion 33 is formed by the outer guide member 18 and the inner guide member 19 that face each other at a predefined interval. The outer guide member 18 and the inner guide member 19 extend in the left-right direction 9 that is orthogonal to the paper surface of FIG. 2. The straight portion 34 is formed by the recording unit 24 and the platen 42 that face each other at a predefined interval in a position where the recording unit 24 is disposed.

The sheet 12 supported by the feed tray 20 is conveyed through the curved portion 33 by use of the feed roller 25, and reaches the conveyance roller pair 59 described below. The sheet 12 nipped by the conveyance roller pair 59 is conveyed frontward through the straight portion 34 toward the recording unit 24. The recording unit 24 performs printing on the sheet 12 that has reached a position immediately below the recording unit 24. The sheet 12 for which printing is performed is conveyed frontward through the straight portion 34 and discharged on the discharge tray 21. Accordingly, the sheet 12 is conveyed in a conveyance direction 15 indicated by arrows of the dot-dash chain line in FIG. 2.

Platen 42

As depicted in FIG. 2, the platen 42 (an exemplary platen) is disposed in the straight portion 34 of the conveyance path 65. In this embodiment, the platen 42 is a black plate-like member. The platen 42 faces the recording unit 24 in the up-down direction 7. The platen 42 supports the sheet 12 conveyed through the conveyance path 65 from below.

Recording Unit 24

As depicted in FIG. 2, the recording unit 24 is disposed above the straight portion 34. The recording unit 24 includes a carriage 40, a head 38, and a sensor 120 (see FIG. 3).

The carriage 40 is supported by two guide rails 56 and 57 arranged in the front-rear direction 8 at an interval so that the carriage 40 is movable in the left-right direction 9 orthogonal to the conveyance direction 15. Namely, the carriage 40 is movable leftward (an exemplary first direction) and rightward (an exemplary second direction). The carriage 40 moves in the left-right direction 9 so that a lower surface 67 of the carriage 40 and a lower surface 68 of the head 38 face the platen 42 in the up-down direction 7. The moving direction of the carriage 40 is not limited to the left-right direction 9, provided that the moving direction intersects with the conveyance direction 15.

The guide rail 56 is disposed upstream of the head 38 in the conveyance direction 15. The guide rail 57 is disposed downstream of the head 38 in the conveyance direction 15. The guide rails 56 and 57 are supported by side frames (not depicted) arranged outside the straight portion 34 of the conveyance path 65 in the left-right direction 9. The carriage 40 moves when receiving driving force from a carriage drive motor 103 (see FIG. 4).

The guide rail 56 or 57 includes an encoder strip (not depicted) extending in the left-right direction 9. A pattern, in which light transmissive portions through which light transmits and light blocking portions by which light is blocked are arranged alternately in the left-right direction 9 at regular pitches, is put on the encoder strip. An optical sensor 35 (see FIG. 4) is provided in the carriage 40 at a position facing the encoder strip. An electrical signal detected by the optical sensor 35 is output to the controller 130 (see FIG. 4).

As depicted in FIG. 2, the head 38 is carried on the carriage 40. The head 38 includes sub-tanks (not depicted), nozzles 39, ink channels (not depicted), and piezoelectric elements 45 (see FIG. 4).

Figure 3:
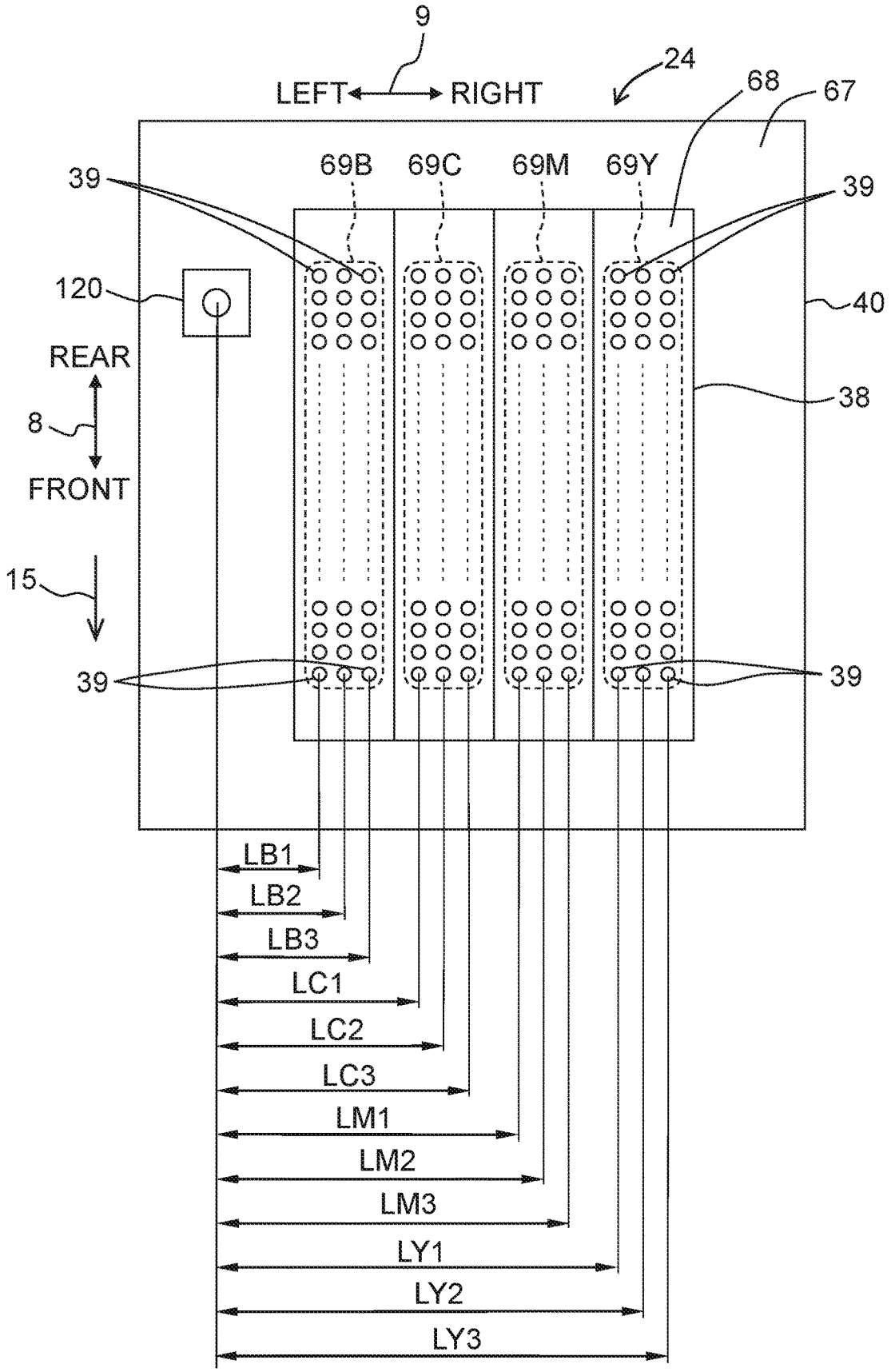
FIG. 3 is a bottom view of a recording unit 24.

Inks are supplied from ink cartridges (not depicted), ink tanks (not depicted), or the like to the sub-tanks respectively. As depicted in FIG. 3, the nozzles 39 are open in the lower surface 68 (an exemplary nozzle surface) of the head 38. Namely, the lower surface 68 includes openings (nozzles 39). The lower surface 68 extends in the front-rear direction 8 and the left-right direction 9. Namely, the lower surface 68 is parallel to the moving direction of the carriage 40. The lower surface 68 is exposed to the lower side through the openings formed in the lower surface 67 of the carriage 40. The ink channels connect the sub-tanks and the nozzles 39. Each of the piezoelectric elements 45 depicted in FIG. 4 deforms part of the ink channel, thus discharging ink droplets from the corresponding nozzle 39. The piezoelectric elements 45 operate when receiving power from the controller 130 (see FIG. 4).

In this embodiment, the sub-tanks are four sub-tanks, and each of the sub-tanks contains one of cyan ink, magenta ink, yellow ink, and blank ink. The nozzles 39 form nozzle groups 69C, 69M, 69Y, and 69B. The nozzle group 69C is connected to the sub-tank for cyan ink, the nozzle group 69M is connected to the sub-tank for magenta ink, the nozzle group 69Y is connected to the sub-tank for yellow ink, and the nozzle group 69B is connected to the sub-tank for black ink. Each of the nozzle groups 69C, 69M, 69Y, and 69B is configured by at least one nozzle row. Each nozzle row is configured by nozzles arrayed in the conveyance direction 15. When multiple nozzle rows are arranged, the nozzle rows are arranged in the left right direction 9. In FIG. 3, each of the nozzle groups 69C, 69M, 69Y, and 69B is configured by three nozzle rows.

Cyan ink droplets are discharged from each nozzle configuring the nozzle group 69C. Magenta ink droplets are discharged from each nozzle configuring the nozzle groups 69M. Yellow ink droplets are discharged from each nozzle configuring the nozzle group 69Y. Black ink droplets are discharged from each nozzle configuring the nozzle group 69B. Namely, four kinds of ink droplets are discharged from the nozzles 39.

The number of sub-tanks is not limited to four. Namely, the number of ink colors stored in the sub-tanks is not limited to four, the number of nozzle groups configured by the nozzles 39 is not limited to four, and the number of ink droplet colors discharged from the nozzles 39 is not limited to four.

The sensor 120 detects the sheet 12 conveyed through the conveyance path 65. The sensor 120 is carried on the carriage 40. The sensor 120 is exposed to the lower side through the openings formed in the lower surface 67 of the carriage 40 so that the sensor 120 can face the platen 42 and the sheet 12 supported by the platen 42. The carriage 40 carries the sensor 120 on the left side of the nozzles 39.

The sensor 120 includes a light emitting portion (not depicted) configured by a light emitting diode or the like and a light receiving portion (not depicted) configured by a light receiving sensor or the like. Being controlled by the controller 130, the light emitting portion emits light downward in a state where the sensor 120 faces the platen 42 in the up-down direction 7. Light emitted from the light emitting portion reflects at the platen 42 positioned below the recording unit 24 or the sheet 12 supported by the platen 42. Light reflected at the platen 42 or the sheet 12 is received by the light receiving portion. The sensor 120 outputs, to the controller 130, an electrical signal depending on a light receiving amount of the reflected light in the light receiving portion. For example, the sensor 120 outputs an electrical signal having a higher level to the controller 130 as the light receiving amount is larger.

As described above, in this embodiment, the platen 42 is a black member. The sheet 12 has a color paler or lighter than black, such as white. Thus, when light emitted from the light emitting portion hits the platen 42 and is reflected thereby, the light receiving amount of the reflected light in the light receiving portion is small. In that case, the sensor 120 outputs a low-level (a level smaller than a preset threshold value) electrical signal to the controller 130. When light emitted from the light emitting portion hits the sheet 12 and is reflected thereby, the light receiving amount of the reflected light in the light receiving portion is large. In that case, the sensor 120 outputs a high-level (a level higher than the preset threshold value) electrical signal to the controller 130.

Unlike the above configuration, the sensor 120 may output an electrical signal having a lower level to the controller 130 as the light receiving amount is larger. Or, instead of outputting the low-level electrical signal to the controller 130, the sensor 120 may output no electrical signal to the controller 130. The sensor 120 is not limited to the above optical sensor provided that the sensor 120 can detect the sheet 12 conveyed through the conveyance path 65. The sensor 120 may be any other publicly-known sensor, such as a CCD image sensor or a mechanical sensor.

The recording unit 24 is controlled by the controller 130 (see FIG. 4). The head 38 discharges ink droplets from the nozzles 39 toward the platen 42 during movement in the left-right direction 9 of the carriage 40. Specifically, ink droplets are discharged to the sheet 12 supported by the platen 42. Accordingly, printing is performed on the sheet 12, which is conveyed through the straight portion 34 in the conveyance direction 15 and is supported by the platen 42.

Conveyance Roller Pair 59 and Discharge Roller Pair 44

As depicted in FIG. 2, the conveyance roller pair 59 (an exemplary conveyer) is provided for the straight portion 34 at the upstream side of the head 38 and the platen 42 in the conveyance direction 15. The discharge roller pair 44 is provided for the straight portion 34 at the downstream side of the head 38 and the platen 42 in the conveyance direction 15.

The conveyance roller pair 59 includes a conveyance roller 60 and a pinch roller 61, which is disposed on the lower side of the conveyance roller 60 to face the conveyance roller 60. The pinch roller 61 is urged or pressed against the conveyance roller 60 by an elastic member (not depicted), such as a coil spring. The conveyance roller pair 59 can nip the sheet 12.

The discharge roller pair 44 includes a discharge roller 62 and a spur roller 63, which is disposed on the upper side of the discharge roller 62 to face the discharge roller 62. The spur roller 63 is urged or pressed against the discharge roller 62 by an elastic member (not depicted), such as a coil spring. The discharge roller pair 44 can nip the sheet 12.

The conveyance roller 60 and the discharge roller 62 rotate when receiving driving force from a conveyance motor 101 (see FIG. 4). Rotating the conveyance roller 60 in a state where the sheet 12 is nipped by the conveyance roller pair 59 causes the conveyance roller pair 59 to convey the sheet 12 in the conveyance direction 15 so that the sheet 12 reaches the platen 42. Rotating the discharge roller 62 in a state where the sheet 12 is nipped by the discharge roller pair 44 causes the discharge roller pair 44 to convey the sheet 12 in the conveyance direction 15 so that the sheet 12 is discharged on the discharge tray 21. The conveyance motor 101 and the feed motor 102 may be a common motor. In that case, the common motor includes switchable drive transmission paths by which driving force can be transmitted from the common motor to each of the rollers.

The sheet 12 may be conveyed by any other components or mechanisms without being limited to the above roller pairs. For example, a conveyance belt may be provided instead of the conveyance roller pair 59 and the discharge roller pair 44.

Rotary Encoder

The conveyance motor 101 includes a rotary encoder (not depicted) that detects a rotation amount of the conveyance motor 101. The rotary encoder is configured by an optical sensor 75 (see FIG. 4) and an encoder disk (not depicted) that is provided in a shaft of the conveyance motor 101 to rotate together with the conveyance motor 101. The encoder disk has a pattern in which light transmissive portions through which light transmits and light blocking portions by which light is blocked are arranged alternately in its circumferential direction at regular pitches. Rotation of the encoder disk generates a pulse signal every time the optical sensor 75 detects the light transmissive portion or the light blocking portion. The pulse signal generated is outputted to the controller 130 (see FIG. 4). The controller 130 calculates a rotation amount of the conveyance motor 101 based on the pulse signal. The rotary encoder may be provided, for example, in the feed motor 102 and/or the conveyance motor 60, in addition to the conveyance motor 101.

Controller 130 and Memory 140

Referring to FIG. 4, configurations of the controller 130 and the memory 140 are explained. The present disclosure is achieved by causing the controller 130 to execute pieces of processing in accordance with the flowcharts described below. The controller 130 controls the whole operation of the multifunction peripheral 10. The controller 130 includes a CPU 131 and an ASIC 135. The memory 140 includes a ROM 132, a RAM 133, and an EEPROM 134. The CPU 131, ASIC 135, ROM 132, RAM 133, and EEPROM 134 are connected to one another by an internal bus 137.

The ROM 132 stores programs and the like for allowing the CPU 131 to control a variety of operations. The RAM 133 is used as a storage area in which data, signals, and the like, used by the CPU 131 when the above programs are executed, are stored temporarily, or a working area for data processing. The EEPROM 134 stores settings, flags, and the like that are required to be held or kept after the multifunction peripheral 10 is turned off.

The memory 140 (ROM 132 in this embodiment) stores pieces of information on distances in the left-right direction 9 between the nozzles 39 and the sensor 120. The pieces of distance information are distance values indicated in FIG. 3 (LB1, LB2, LB3, LC1, LC2, LC3, LM1, LM2, LM3, LY1, LY2, and LY3). The distance values LB1, LB2, and LB3 are distance values in the left-right direction 9 between the respective nozzle rows of the nozzle group 69B and the sensor 120. The distance values LC1, LC2, and LC3 are distance values in the left-right direction 9 between the respective nozzle rows of the nozzle group 69C and the sensor 120. The distance values LM1, LM2, and LM3 are distance values in the left-right direction 9 between the respective nozzle rows of the nozzle group 69M and the sensor 120. The distance values LY1, LY2, and LY3 are distance values in the left-right direction 9 between the respective nozzle rows of the nozzle group 69Y and the sensor 120.

In this embodiment, the ROM 132 stores the distances in the left-right direction 9 between the sensor 120 and all the nozzle rows. The ROM 132, however, may store distances in the left-right direction 9 between the sensor 120 and some of the nozzle rows. For example, the pieces of distance information may be distances in the left-right direction 9 between the sensor 120 and nozzle rows (LB1, LB3, LC1, LC3, LM1, LM3, LY1, and LY3), of all the nozzle rows belonging to the respective nozzle groups, disposed at a right end and a left end. Namely, the distances in the left-right direction 9 between the sensor 120 and nozzle rows (LB2, LC2, LM2, and LY2), of all the nozzle rows belonging to the respective nozzle groups, except for the nozzle rows disposed at the right and left ends may be removed from the distance information.

In this embodiment, the memory 140 stores the pieces of information on distances in the left-right direction 9 between the sensor 120 and multiple nozzles 39. The memory 140, however, may not store the pieces of distance information as described above. For example, the memory 140 may store pieces of information on positions in the left-right direction 9 of multiple nozzles 39 and a piece of information on a position in the left-right direction 9 of the sensor 120. In that configuration, the controller 130 reads the pieces of position information of each nozzle 39 and the sensor 120 from the memory 140 and calculates the distance information as described above.

The ASIC 135 is connected to the conveyance motor 101, the feed motor 102, and the carriage drive motor 103. Drive circuits for controlling the respective motors are incorporated in the ASIC 135. The CPU 131 outputs drive signals for rotating the respective motors to the drive circuits corresponding to the respective motors. Each of the drive circuits outputs, to the corresponding motor, a drive current depending on the drive signal from the CPU 131. This rotates the corresponding motor. Namely, the controller 130 controls the feed motor 102, which makes the feed unit 16 feed the sheet 12. Further, the controller 130 controls the conveyance motor 101, which makes the conveyance roller pair 59 and the discharge roller pair 44 convey the sheet 12. The controller 130 controls the carriage drive motor 103 to move the carriage 40.

The ASIC 135 is connected to the optical sensor 83 of the installation sensor 80. The controller 130 determines whether the feed tray 20 is installed in the printer nit 11 based on an electrical signal from the optical sensor 83.

The ASIC 135 is connected to the sensor 120. The controller 130 outputs an electrical signal to the light emitting portion of the sensor 120 through the ASIC 135. The light emitting portion receiving the electrical signal emits light downward. The light receiving portion of the sensor 120 receives light that is emitted from the light emitting portion and is reflected by the platen 42 or the sheet 12. The sensor 120 outputs, to the controller 130, an electrical signal having a level that depends on a light receiving amount of the reflected light in the light receiving portion. The controller 130 recognizes the light receiving amount of the reflected light based on an output result of the sensor 120. In this embodiment, the controller 130 recognizes the light receiving amount of the reflected light based on whether the electrical signal from the sensor 120 is the high level or the low level. In this embodiment, when the electrical signal from the sensor 120 is the high level, the controller 130 determines that the sheet 12 is supported by the platen 42. When the electrical signal from the sensor 120 is the low level, the controller 130 determines that no sheet 12 is supported by the platen 42.

The ASIC 135 is connected to the optical sensor 75 of the rotary encoder. The controller 130 calculates a rotation amount of the conveyance motor 101 based on an electrical signal from the optical sensor 75.

The ASIC 135 is connected to the optical sensor 35 of the encoder strip. The controller 130 recognizes a position of the carriage 40 based on an electrical signal from the optical sensor 35.

The ASIC 135 is connected to the piezoelectric elements 45. The piezoelectric elements 45 operate by receiving power from the controller 130 via a drive circuit (not depicted). The controller 130 controls power feeding to the piezoelectric elements 45 to selectively discharge ink droplets from each of the nozzle groups 69C, 69M, 69Y, and 69B.

In a case of performing printing on the sheet 12, the controller 130 controls the conveyance motor 101 to execute intermittent conveyance processing in which the conveyance roller pair 59 and the discharge roller pair 44 alternately repeat conveyance of the sheet 12 by a predefined conveyance amount and a stop of conveyance. The conveyance amount of the sheet 12 is recognized, for example, by causing the rotary encoder described above to count a rotation amount of the conveyance roller 60.

The controller 130 executes print processing in a state where conveyance of the sheet 12 is stopped in the intermittent conveyance processing. In the print processing, power feeding to the piezoelectric elements 45 is controlled to discharge ink droplets from the nozzles 39 during movement in the left-right direction 9 of the carriage 40. Namely, the controller 130 executes, in the print processing, one printing pass by which ink droplets are discharged from the nozzles 39 during rightward or leftward movement of the carriage 40. Accordingly, printing corresponding to one pass is performed on the sheet 12. In the following, executing the printing pass is also simply referred to as executing a pass, and executing one printing pass is also referred to as executing printing corresponding to one pass.

The entire area of the sheet 12, on which printing can be performed, can be subjected to printing by alternately repeating the intermittent conveyance processing and the printing corresponding to one pass. Namely, the controller 130 performs printing on one sheet 12 by performing printing corresponding to multiple passes.

The controller 130 is not limited to the above configuration. In the controller 130, only the CPU 131 may perform various kinds of processing, only the ASIC 135 may perform various kinds of processing, or the CPU 131 may cooperate with the ASIC 135 to perform various kinds of processing. In the controller 130, the CPU 131 may perform a piece of processing alone, or pieces of the CPU 131 may perform a piece of processing in a shared fashion. Or, the ASIC 135 may perform a piece of processing alone, or pieces of the ASIC 135 may perform a piece of processing in a shared fashion.

Printing Control by Controller 130

The printer unit 11 configured as described above executes a series of printing control in which the controller 130 feeds the sheet 12 and printing is performed on the fed sheet 12. In the following, the series of printing control processing is explained while referring to the flowchart of FIG. 5.

When printing data, which is data of an image to be printed on the sheet 12, is sent from the operation unit 17 (see FIG. 1) of the multifunction peripheral 10 or an external apparatus connected to the multifunction peripheral 10 to the controller 130 (S10), the controller 130 receiving the printing data drives the feed motor 102 so that the feed roller 25 feeds the sheet 12 supported by the feed tray 20 to the conveyance path 65 (S20). Further, the controller 130 drives the conveyance motor 101 so that the conveyance roller pair 59 conveys the sheet 12 in the conveyance direction 15 until the sheet 12 reaches a printing start position facing the recording unit 24 (S20). In the printing start position, a downstream end in the conveyance direction 15 of a printing area of the sheet 12 faces nozzles 39, of all the nozzles 39, disposed at the most downstream side in the conveyance direction 15.

Subsequently, the controller 130 determines whether the carriage 40 is in a start position based on an electrical signal from the optical sensor 35 of the encoder strip (S30). The processing of a step S30 may be executed in parallel to the processing of the step S20.

The start position is a movement start position of the carriage 40 in the first pass (the first printing pass) for the sheet 12, among multiple passes for printing on the sheet 12. For example, when the carriage 40 moves rightward in the first pass, the start position is a position where the rightmost nozzle 39 to be used in the first pass is in the vicinity of and on the left side of a left end of the image to be printed on the sheet 12 (hereinafter also referred to as a left start position). When the carriage 40 moves leftward in the first pass, the start position is a position where the leftmost nozzle 39 to be used in the first pass is in the vicinity of and on the right side of a right end of the image to be printed on the sheet 12 (hereinafter also referred to as a right start position). An area of the image to be printed on the sheet 12 in the first pass is determined based on the printing data.

The start position may be any position provided that the rightmost nozzle 39 to be used in the first pass is on the left side of the left end of the image to be printed on the sheet 12 when the carriage 40 moves rightward in the first pass. The start position may be any position provided that the leftmost nozzle 39 to be used in the first pass is on the right side of the right end of the image to be printed on the sheet 12 when the carriage 40 moves leftward in the first pass. For example, the start position may be a position where the carriage 40 is on the left side of the sheet 12 when the carriage 40 moves rightward in the first pass. The start position may be a position where the carriage 40 is on the right side of the sheet 12 when the carriage 40 moves leftward in the first pass.

In this embodiment, the carriage 40 moves rightward from the left start position in the first pass. Namely, in this embodiment, the start position is the left start position. Further, the carriage 40 moves leftward in the next pass of the first pass. Then, the carriage 40 alternately moves leftward and rightward per pass. The moving direction of the carriage 40 in each pass is not limited to the above. For example, the carriage 40 may move leftward from the right start position in the first pass. Namely, the start position may be the right start position.

When the carriage 40 is in the left start position (S30: Yes), printing is performed on the sheet 12 (S50). When the carriage 40 is not in the left start position (S30: No), the controller 130 drives the carriage drive motor 103 to move the carriage 40 to the left start position (S40). Then, the controller 130 executes printing on the sheet 12 (S50). Details of print processing in the step S50 are explained below while referring to FIGS. 6A and 6B.

When the printing on the sheet 12 is completed (S50), the controller 130 drives the conveyance motor 101 so that the discharge roller pair 44 conveys the sheet 12 in the conveyance direction 15 and the sheet 12 is discharged on the discharge tray 21 (S60).

Subsequently, the controller 130 determines whether printing of all pieces of printing data received in the step S10 is performed on the sheet(s) 12, in other words, whether the sheet 12 for which printing is performed most recently is the last page (S70).

When the sheet 12 for which printing is performed most recently is not the last page (S70: No), the controller 130 drives the feed motor 102 so that the feed roller 25 feeds the uppermost sheet 12 supported by the feed tray 20 to the conveyance path 65 (S20). Then, the controller 130 executes printing and the like on this sheet 12 (S30 to S60). Feeding of the uppermost sheet 12 stored in the feed tray 20 by the feed roller 25 (S20), discharge of the sheet 12 for which printing is performed (S60), and determination whether the sheet 12 for which printing is performed is the last page (S70) may be executed in parallel.

When the sheet 12 for which printing is performed most recently is the last page (S70: Yes), the series of printing control processing is completed.

Printing by Controller 130

Figure 5:
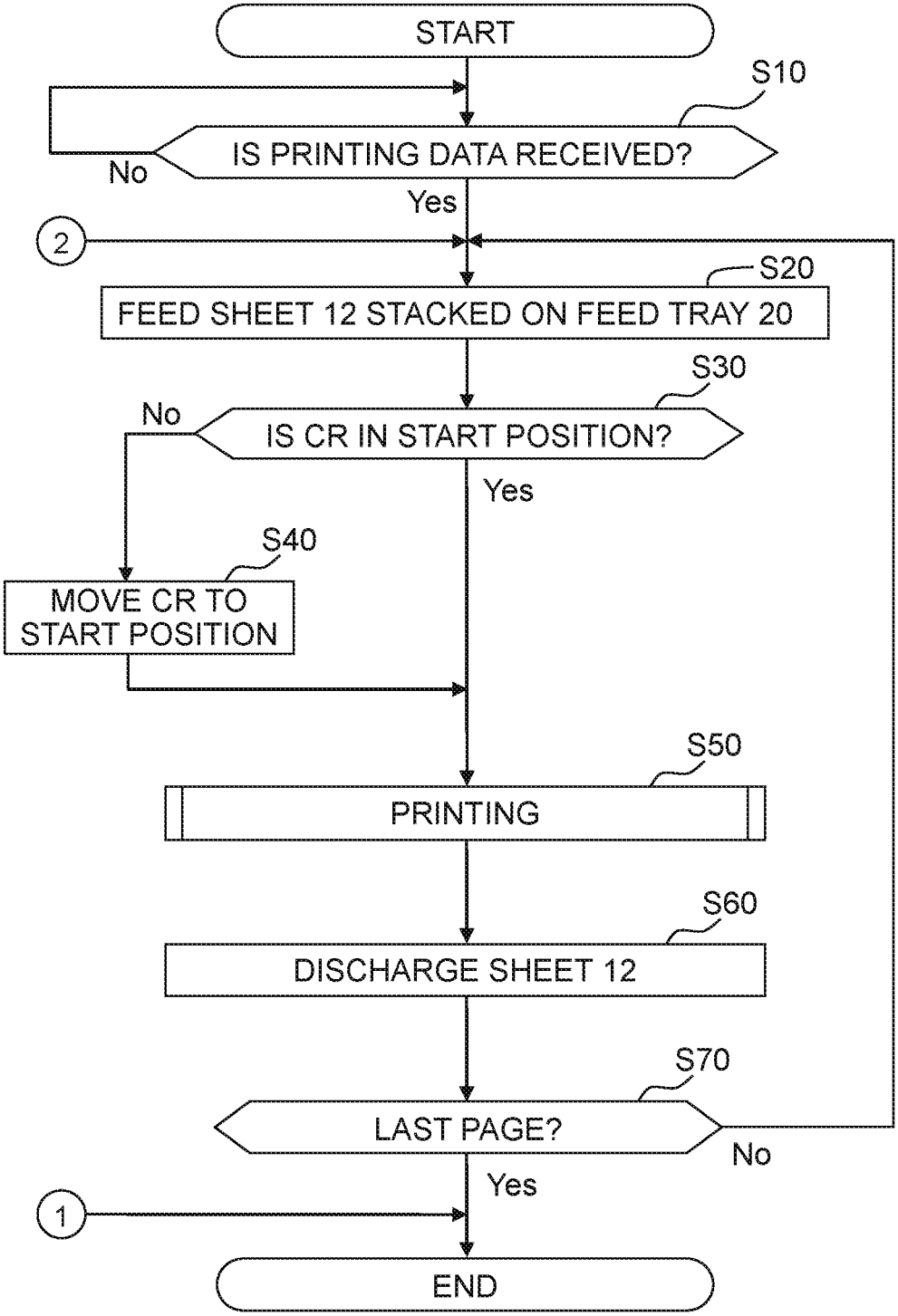
FIG. 5 is a flowchart for explaining printing control processing.
Figure 6A:
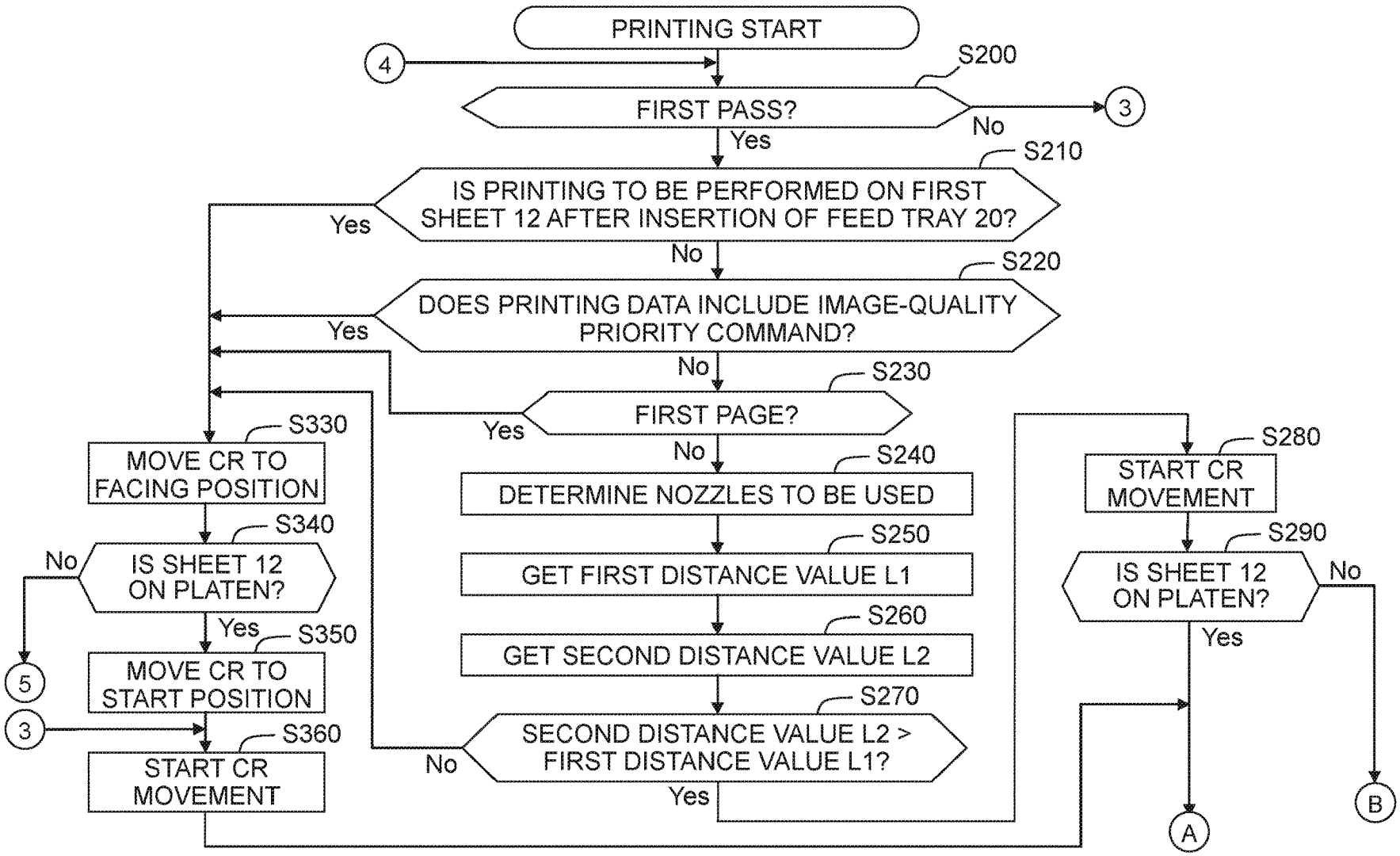
FIGS. 6A and 6B depict a flowchart for explaining print processing executed in a step S50 of FIG. 5.
Figure 6B:
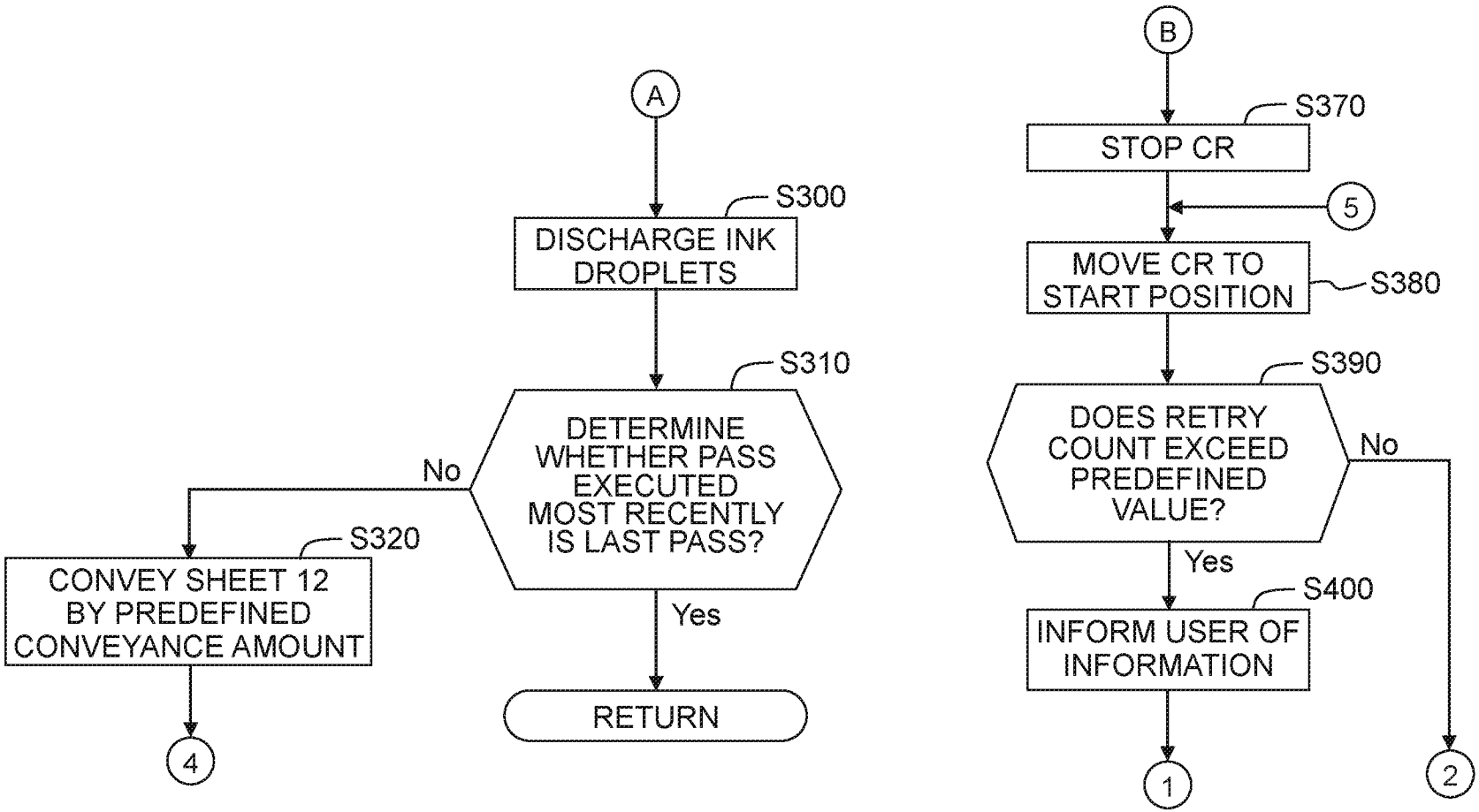

Referring to FIGS. 6A and 6B, the print processing in the step S50 of FIG. 5 is explained below.

The controller 130 determines whether to execute any of first processing and second processing, based on conditions described below (S200 to S230). In the first processing, the controller 130 determines whether the sheet 12 is supported by the platen 42, and then printing corresponding to one pass is performed during movement of the carriage 40 (S330 to S360, S300). In the second processing, the controller 130 determines whether the sheet 12 is supported by the platen 42 while the carriage 40 moves in printing corresponding to one pass (S240 to S300).

The controller 130 at first executes determination in the step S200. Namely, the controller 130 determines whether processing in a step S320 described below is executed immediately before the step S200 (in other words, whether movement of the carriage 40 in the printing on the sheet 12 to be executed from now on is the first pass). The printing in the first pass, namely, the printing corresponding to one pass to be executed on the sheet 12 first is an exemplary certain printing pass.

When movement of the carriage 40 in the printing to be executed on the sheet 12 from now on is not the first pass for the sheet 12 (S200: No), the controller 130 executes the processing in the step S360 and pieces of the processing subsequent to the step S360. Namely, the controller 130 executes the printing corresponding to one pass (S360, S300) without detecting whether the sheet 12 is supported by the platen 42 (S340, S290). When movement of the carriage 40 in the printing to be executed on the sheet 12 from now on is the first pass for the sheet 12 (S200: No), the controller 130 executes determination of a step S210.

Although the steps S210 to S230 may be executed in any order, in this embodiment, the controller 130 executes determination of the step S210 first. Namely, when printing data received in the step S10 (see FIG. 5) is first printing data after the feed tray 20 is installed in the printer unit 11 (after the electrical signal from the optical sensor 83 is changed from the high level to the low level) (S210: Yes), the controller 130 executes the first processing. When printing data received in the step S10 (see FIG. 5) is not the first printing data after the feed tray 20 is installed in the printer unit 11 (S210: No), the controller 130 executes determination of the step S220.

In the step S220, the controller 130 refers to the printing data received in the step S10 (see FIG. 5). The printing data may include an image-quality priority command. The image-quality priority command, which is sent to the controller 130, indicates that printing is to be executed on the sheet 12 by a mode in which quality of the image to be printed on the sheet 12 has priority over fast speed of printing to be executed on the sheet 12 (in other words, over a short time required for printing to be executed on the sheet 12).

When the printing data received in the step S10 (see FIG. 5) includes the image-quality priority command (S220: Yes), the controller 130 executes the first processing. When the printing data received in the step S10 (see FIG. 5) does not include the image-quality priority command (S220: No), the controller 130 executes determination of the step S230.

In the step S230, the controller 130 determines whether printing of the printing data received in the step S10 (see FIG. 5) is not yet performed on the sheet 12. When printing of the printing data received in the step S10 (see FIG. 5) is not yet performed on the sheet 12, namely, when printing to be executed from now on is printing of the printing data on the first page (S230: YES), the controller 130 executes the first processing. When printing of at least part of the printing data is already performed on the sheet 12, namely, when printing to be executed from now on is not printing of the printing data on the first page (S230: No), the controller 130 executes the second processing.

Thus, the presence or absence of the sheet 12 on the platen 42 is detected in the first pass (S200; Yes) for the sheet 12, and the presence or absence of the sheet 12 on the platen 42 is not detected in any other passes than the first pass for the sheet 12 (S200; No). When printing is to be performed on the first sheet 12 after insertion of the feed tray 20 (S210: Yes), when printing is to be performed by the image-quality priority mode (S220: Yes), or when printing is to be performed on the first sheet 12 among multiple pieces of sheet 12 (S230: Yes), the presence or absence of the sheet 12 on the platen 42 is detected in the first processing. When none of the conditions of the steps S210 to S230 is satisfied (S210: No, S220: No, S230: No), the presence or absence of the sheet 12 on the platen 42 is detected in the second processing.

The first processing (S330 to S360) is explained below.

The controller 130 drives the carriage drive motor 103 to move the carriage 40 to a facing position (S330). In the facing position, the sensor 120 carried on the carriage 40 faces any portion of the sheet 12 (e.g., a center, right end, or left end in the left-right direction 9 of the sheet 12) when the sheet 12 fed in the step S20 (see FIG. 5) is supported by the platen 42.

Subsequently, the controller 130 determines whether the sheet 12 is supported by the platen 42 (S340). The controller 130 outputs an electrical signal to the light emitting portion of the sensor 120. The controller 130 determines that the sheet 12 is not supported by the platen 42 when the electrical signal from the sensor 120 is the low level (S340: No). Then, the controller 130 executes the processing in a step S380 and pieces of processing subsequent to the step S380 described below.

The controller 130 determines that the sheet 12 is supported by the platen 42 (S340: Yes) when the electrical signal from the sensor 120 is the high level. In that case, the controller 130 drives the carriage drive motor 103 to move the carriage 40 to the left start position (S350). Then, the controller 130 executes discharge of ink droplets from the nozzles 39 (S300) based on the printing data received in the step S10 (see FIG. 5) while moving the carriage 40 rightward (S360). Namely, the controller 130 executes the certain printing pass that is the first one pass for the sheet 12.

The second processing (S240 to S290) is explained below.

The controller 130 determines the nozzles 39 to be used in a pass (certain printing pass), which is to be executed on the sheet 12 from now on (S240).

In the step S240, the controller 130 determines the nozzles 39 (hereinafter also referred to as nozzles for use 39) to be used in the first pass (certain printing pass) for the sheet 12, based on printing condition information included in the printing data received in the step S10 (see FIG. 5).

In this embodiment, the printing condition information is information on ink color(s) to be used in printing. For example, when the printing condition information is information in which only the black color is to be used in printing, the nozzles for use 39 are the nozzle group 69B. For example, when the printing condition information is information in which colors except for the black color are to be used in printing, the nozzles for use 39 are the nozzle groups 69C, 69M, and 69Y. For example, when the printing condition information is information in which all the colors are to be used in printing, the nozzles for use 39 are the nozzle groups 69B, 69C, 69M, and 69Y.

Subsequently, the controller 130 gets a first distance value L1 based on the nozzles for use 39 determined in the step S240 and the distance information stored in the memory 140 (S250). The first distance value L1 is a distance value in the left-right direction 9 between the sensor 120 and most downstream nozzles which are included in the nozzles 39 to be used in the certain printing pass and positioned most downstream in the moving direction of the carriage 40. As described above, in this embodiment, the carriage 40 moves rightward from the left start position in the first pass for the sheet 12. Thus, in this embodiment, the moving direction of the carriage 40 is the rightward direction.

For example, when the nozzles for use 39 determined in the step S240 are the nozzle group 69B, the first distance value L1 is a distance value LB3 (see FIG. 3) in the left-right direction 9 between the sensor 120 and the nozzles 39 positioned at the right end of the nozzle group 69B. For example, when the nozzles for use 39 determined in the step S240 are the nozzle groups 69C, 69M, and 69Y, the first distance value L1 is a distance value LY3 in the left-right direction 9 between the sensor 120 and the nozzles 39 positioned at the right ends of the nozzle group 69Y.

Subsequently, the controller 130 gets a second distance value L2 based on the printing data received in the step S10 (see FIG. 5) (S260). The second distance value L2 is a distance value in the left-right direction 9 between an end that is included in left and right ends of the sheet 12 and above which the most downstream nozzles pass first in the certain printing pass and a close landing position which is included in landing positions on which ink droplets land from the most downstream nozzles and which is closest in the left-right direction 9 to the end of the sheet 12.

Figure 7:
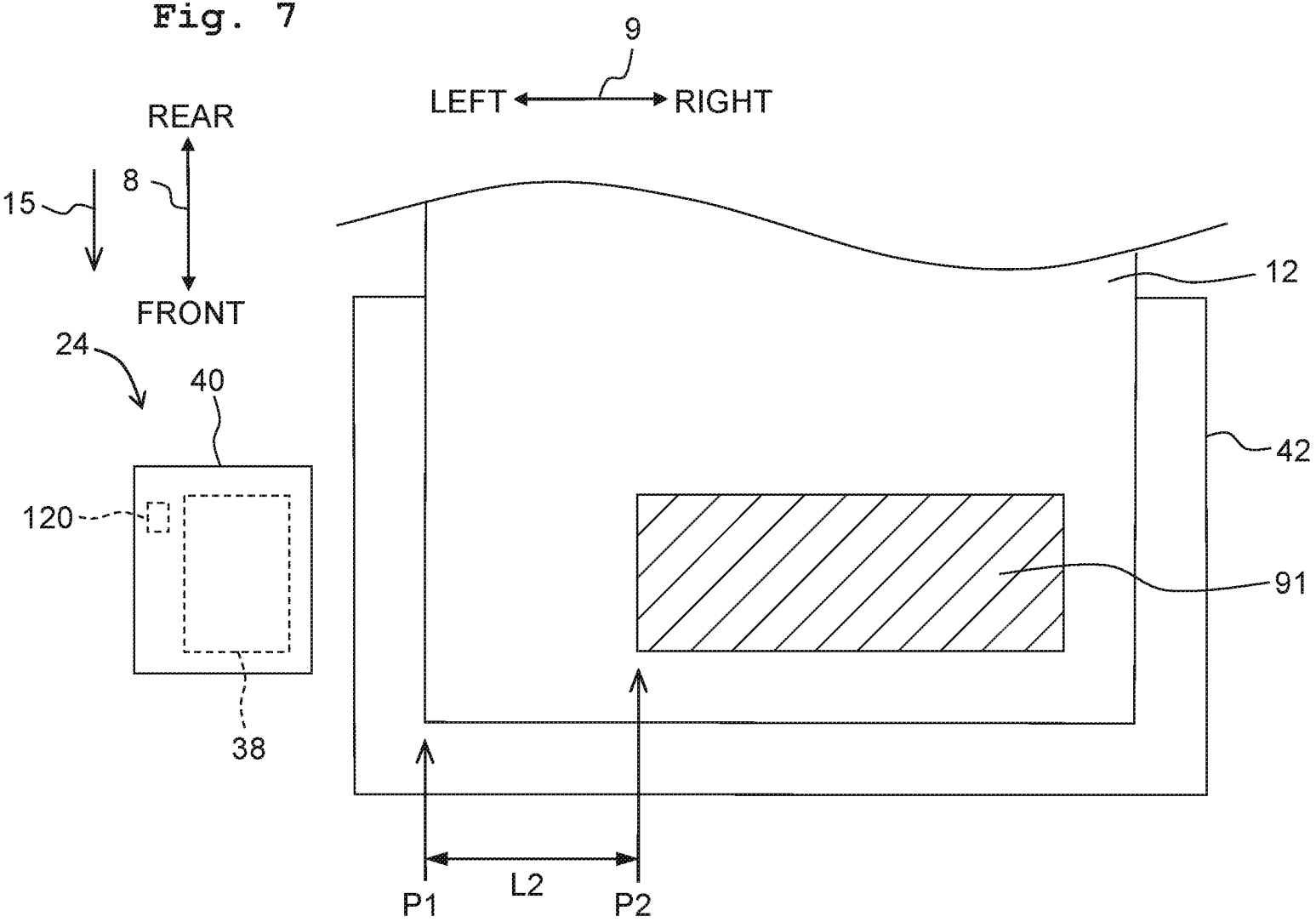
FIG. 7 is a plan view of a recording unit 24 and a platen 42.

For example, as depicted in FIG. 7, the carriage 40 in the left start position may be on the left side of the sheet 12 supported by the platen 42 and the landing positions of ink droplets from the most downstream nozzles in the certain printing pass may be included in a hatched area 91. In that case, the end of the sheet 12 is the left end of the sheet 12, and thus the position in the left-right direction 9 of the end is a position P1 and the close landing position is a position P2. The second distance value L2 is thus a distance value in the left-right direction 9 between the position P1 and the position P2.

Subsequently, the controller 130 determines whether the second distance value L2 is larger than the first distance value L1 (S270). When the second distance value L2 is equal to or less than the first distance value L1 (S270: No), the most downstream nozzles face the landing positions of the ink droplets (area 91) with the sensor 120 facing the sheet 12. In that case, the sensor 120 can not detect whether the sheet 12 is on the platen 42 before ink droplets are discharged from the nozzles 39 to the landing positions. Thus, the controller 130 executes the first processing (S330).

When the second distance value L2 is larger than the first distance value L1 (S270: Yes), the sensor 120 can detect whether the sheet 12 is on the platen 42 before ink droplets are discharged from the nozzles 39 to the landing positions. In that case, the controller 130 moves the carriage 40 rightward from the left start position (S280).

The controller 130 determines whether the sheet 12 is supported by the platen 42 during the rightward movement of the carriage 40 that started in the step S280 (S290). The controller 130 outputs an electrical signal to the light emitting portion of the sensor 120 before ink droplets are discharged from the nozzles 39 based on the printing data received in the step S10 (see FIG. 5). When the electrical signal from the sensor 120 is the low level, the controller 130 determines that no sheet 12 is supported by the platen 42 (S290: No) and stops the carriage 40 without discharging ink droplets from the nozzles 39 (S370). Namely, the controller 130 cancels the printing.

When the electrical signal from the sensor 120 is the high level, the controller 130 determines that the sheet 12 is supported by the platen 42 (S290: Yes). In that case, the controller 130 executes discharge of ink droplets from the nozzles 39 based on the printing data received in the step S10 (see FIG. 5) without stopping the rightward movement of the carriage 40 (i.e., while continuing the rightward movement of the carriage 40 that started in the step S280) (S300). Namely, the controller 130 executes the first pass (certain printing pass) for the sheet 12.

After discharge of ink droplets in the step S300, the controller 130 determines, based on the printing data received in the step S10 (see FIG. 5), whether the pass executed most recently (movement of the carriage 40 in the steps S360, S280 executed most recently) is the last pass for the sheet 12, in other words, whether the printing on the sheet 12 is completed in the step S300 executed most recently (S310).

When the pass executed most recently is not the last pass for the sheet 12 (S310: No), the controller 130 drives the conveyance motor 101 so that the conveyance roller pair 59 and the discharge roller pair 44 convey the sheet 12 by the predefined conveyance amount (S320). Subsequently, the controller 130 executes determination in the step S200 described above (determination whether movement of the carriage 40 in the printing to be executed on the sheet 12 from now on is the first pass). Since the above movement of the carriage 40 is not the first pass (S200: No), the controller 130 executes the processing in the step S360. Namely, the controller 130 executes discharge of ink droplets from the nozzles 39 (S300) based on the printing data received in the step S10 (see FIG. 5) while moving the carriage 40 in an opposite direction of that in the steps S360, 280 executed most recently. Then, the intermittent conveyance processing (S320) and the printing corresponding to one pass (S360, S300) are alternately repeated until the printing on the sheet 12 is completed (S310: Yes). When the printing on the sheet 12 is completed (S310: Yes), as indicated in FIG. 5, the controller 130 drives the conveyance motor 101 so that the discharge roller pair 44 conveys the sheet 12 in the conveyance direction 15 and the sheet 12 is discharged on the discharge tray 21 (S60).

When the controller 130 has determined that the sheet 12 is not supported by the platen 42 (S340: No) with the carriage 40 being in the facing position (S330), the controller 130 moves the carriage 40 to the left start position without executing the certain printing pass (S380). When the controller 130 has determined that the sheet 12 is not supported by the platen 42 (S290: No) during the rightward movement of the carriage 40 from the left start position (S280), the controller 130 cancels the printing (S370) and moves the carriage 40 to the left start position (S380).

Subsequently, the controller 130 determines whether a count (retry count) counted by the controller 130 that the sheet 12 is not supported by the platen 42 exceeds a predefined value (S390). The controller 130 stores the retry count in the memory 140 (e.g., the RAM 133) at the timing at which the controller 130 has determined that the sheet 12 is not supported by the platen 42. Specifically, the controller 130 stores 1 as the retry count in the memory 140 when the controller 130 has first determined that the sheet 12 is not supported by the platen 42. After that, the controller 130 increments the retry count stored in the memory 140 every time the controller 130 first determines that the sheet 12 is not supported by the platen 42. The predefined value is stored in the memory 140 (e.g., ROM 132). For example, when the predefined value is 3, and when the retry count is equal to or less than 3, the controller 130 determines that the retry count does not exceed the predefined value (S390: No). When the retry count is equal to or more than 4, the controller 130 determines that the retry count has exceeded the predefined value (S390: Yes).

When the controller 130 has determined that the retry count does not exceed the predefined value (S390: No), the controller 130 drives the feed motor 102 again so that the feed roller 25 feeds the sheet 12 supported by the feed tray 20 to the conveyance path 65 (S20).

When the controller 130 has determined that the retry count has exceeded the predefined value (S390: Yes), the controller 130 causes the liquid crystal display 172 (an exemplary informing unit) to inform a user of information in which the sheet 12 is not supported by the platen 42, information in which the multifunction machine 10 is jammed, or the like (S400). Specifically, the liquid crystal display 172 displays the above information thereon. Then, the controller ends the series of printing control (see FIG. 5).

The information in which the sheet 12 is not supported by the platen 42, the information in which the multifunction peripheral 10 is jammed, or the like may be informed by any other unit without being limited to the display of the liquid crystal display 172. For example, the multifunction peripheral 10 may include a speaker, which may inform a user of the information in which the sheet 12 is not supported by the platen 42 through sounds from the speaker, such as a voice or buzzer. In that configuration, the speaker is an exemplary informing unit.

Effects of Embodiment

In this embodiment, the controller 130 detects whether the sheet 12 is supported by the platen 42 (S290) during movement of the carriage 40 in the printing corresponding to one pass (S280). This shortens a time until printing starts.

When the second distance value L2 is equal to or less than the first distance value (S270: No), and when the controller 130 executes detection of the sheet 12 during the movement of the carriage 40 in the printing corresponding to one pass (S290), ink droplets may be discharged from the nozzles 39 before the controller 130 determines whether the sheet 12 is supported by the platen 42. When the sheet 12 is not supported by the platen 42, ink droplets adhere to the platen 42. In this embodiment, however, after determining that the second distance value L2 is larger than the first distance value L1 (S270: Yes), the controller 130 detects whether the sheet 12 is supported by the platen 42 during movement of the carriage 40 in the printing corresponding to one pass (S290). This prevents ink droplets from adhering to the platen 42.

When the second distance value L2 is equal to or less than the first distance value (S270: No), and when the controller 130 executes detection of the sheet 12 during the movement of the carriage 40 in the printing corresponding to one pass (S290), ink droplets may be discharged from the nozzles 39 before the controller 130 determines whether the sheet 12 is supported by the platen 42. When the sheet 12 is not supported by the platen 42, ink droplets adhere to the platen 42. In this embodiment, however, after determining that the second distance value L2 is equal to or less than the first distance value L1 (S270: No), the controller 130 detects whether the sheet 12 is supported by the platen 42 before the certain printing pass (S360, S300) starts. This prevents ink droplets from adhering to the platen 42.

In this embodiment, the sensor 120 is carried on the carriage 40 such that the sensor 120 is positioned at the left side of the head 38. In that configuration, when the carriage 40 moves rightward in the certain printing pass (S280, S300) as in this embodiment, the nozzles 39 of the head 38 are on the right of the sensor 120 before the certain printing pass starts. Namely, when the carriage 40 moves rightward, the nozzles 39 of the head 38 reach a position immediately above the sheet 12 earlier than the sensor 120. Thus, this embodiment is a preferred example to which the present disclosure is applied.

When the controller 130 has detected that the sheet 12 is supported by the platen 42 (S290: Yes) before starting the printing corresponding to one pass to be executed first in the printing on the sheet 12 (S300), the controller 130 is not required to detect whether the sheet 12 is supported by the platen 42 in passes subsequent to the above pass in the printing on the sheet 12. In this embodiment, since the controller 130 detects whether the sheet 12 is supported by the platen 42 in the printing corresponding to one pass to be executed first in the printing on the sheet 12, it is possible to omit detection whether the sheet 12 is supported by the platen 42 in passes subsequent to the above pass in the printing on the sheet 12. This shortens the time required for the printing on the sheet 12.

In this embodiment, when the sheet 12 is not supported by the platen 42 (S340: No, S290: NO), printing is canceled (S370). This prevents ink droplets discharged from the nozzles 39 from adhering to the platen 42.

In this embodiment, the liquid crystal display 172 informs a user of the information in which the sheet 12 is not supported by the platen 42 (S400).

In the processing in the step S240 of this embodiment, the nozzle(s) 39 that is/are not to be used based on the printing condition(s) can be removed from the nozzles 39 to be used in the certain printing pass (S300). This prevents the first distance value L1 from being large which may otherwise be caused by the unused nozzles 39 included in the nozzles 39 to be used in the certain printing pass. In that configuration, since the second distance value L2 is highly likely to be larger than the first distance value L1 (S270: Yes) while the carriage 40 moves before discharge of ink droplets in the certain printing pass, the controller 130 is highly likely to detect (S290) whether the sheet 12 is supported by the platen 42 during the movement of the carriage 40 (S280). This shortens the time until printing starts.

In this embodiment, it is possible to remove the nozzles 39 from which ink droplets of color(s) not to be used in the certain printing pass are discharged, from the nozzles 39 to be used in the certain printing pass.

Modified Embodiment

In the above embodiment, the printing condition information is information on color(s) of ink(s) to be used in printing. The present disclosure, however, is not limited thereto. For example, the printing condition information may be information on kind(s) of ink(s) to be used in printing. The ink-kind information may be pigment, dye, and the like. For example, the head 38 may include two sub-tanks. One of the sub-tanks may store black pigment ink and the other may store black dye ink. In that case, when the printing condition information is information in which the ink to be used in printing is the pigment ink, the controller 130 determines, in the step S240, that the nozzle group 69 from which the black pigment ink is discharged is used as the nozzles for use 39. When the printing condition information is information in which the ink to be used in printing is the dye ink, the controller 130 determines, in the step S240, that the nozzle group 69 from which the black dye ink is discharged is used as the nozzles for use 39.

For example, the head 38 may include five sub-tanks. Two of the five sub-tanks may store the black pigment ink and the black dye ink, respectively, and remaining three of the five sub-tanks may store cyan ink, magenta ink, and yellow ink, respectively. In that configuration, the printing condition information may be both pieces of information on color(s) of ink(s) to be used in printing and information on kind(s) of ink(s) to be used in printing.

In the modified embodiment, it is possible to remove the nozzles 39 from which ink droplets of kind(s) of ink(s) not to be used in the certain printing pass are discharged, from the nozzles 39 to be used in the certain printing pass.

In the above embodiment, the carriage 40 moves rightward in the certain printing pass. The carriage 40, however, may move leftward in the certain printing pass.

In the above embodiment, the controller 130 detects whether the sheet 12 is on the platen 42 in the first pass for the sheet 12 (S200: Yes). The controller 130 does not detect whether the sheet 12 is on the platen 42 in any other passes than the first pass for the sheet 12 (S200: No). Namely, the second processing (S240 to S270) is executed in the first pass for the sheet 12. The second processing, however, may be executed in any other passes (e.g., the second pass for the sheet 12) than the first pass for the sheet 12.

In the above embodiment, the controller 130 executes determination of the steps S210 to S230. The controller 130, however, may not execute determination of the steps S210 to S230. Namely, the first processing and the second processing may be executed in the printing on the first sheet 12 after insertion of the feed tray 20, the first processing and the second processing may be executed in the printing by the image-quality priority mode, or the first processing and the second processing may be executed in the printing on the first sheet 12 among multiple sheets 12.

In the above embodiment, the sensor 120 is the optical sensor including the light emitting portion and the light receiving portion. The present disclosure, however, is not limited thereto. For example, the sensor may be an ultrasonic sensor.

The explanation is made about an example in which the present disclosure is applied to the multifunction peripheral 10 that performs printing on the sheet 12 by discharging ink from nozzles. The present disclosure, however, is not limited thereto. The present disclosure can be applied to a recording apparatus that discharges any other liquid than ink, such as resin or metal in the form of liquid, on a medium, such as a substrate or plywood for traces.

What is claimed is:

1. A printing apparatus, comprising:

a platen configured to support a medium;

a head having a nozzle surface in which a plurality of nozzles are opened;

a carriage carrying the head and configured to move along the nozzle surface in a first direction and a second direction being opposite to the first direction, such that the nozzle surface faces the platen, the carriage including an end in the first direction;

a sensor carried on the carriage at a position in the first direction between the head and the end of the carriage where the sensor is capable of facing the platen and the medium supported by the platen, the sensor being configured to detect the medium;

a memory configured to store distance information about a distance in the first direction between the nozzles and the sensor; and a controller configured to control, based on printing data, the head and the carriage to execute a printing pass in which liquid droplets are discharged from the nozzles to the medium supported by the platen during movement of the carriage, wherein before a certain printing pass being the printing pass corresponding to one pass to be executed, starts, the controller is configured to obtain, based on the printing data and the distance information, a first distance value in the first direction between the sensor and a most downstream nozzle of the nozzles to be used in the certain printing pass and positioned at a most downstream side in a case that the carriage moves in one of the first direction and the second direction, the controller is configured to obtain, based on the printing data, a second distance value in the first direction between an end of the medium and a close landing position in the first direction, the end of the medium being an end which is included in ends in the first direction of the medium and above which the most downstream nozzle passes first in the certain printing pass, the close landing position being a position which is included in landing positions on which liquid droplets land from the most downstream nozzle and is closest to the end in the first direction of the medium, and the controller is configured to continue the certain printing pass without stopping the movement of the carriage, in a case that the controller has determined that the second distance value is larger than the first distance value, and in a case that the controller has determined, based on an output result of the sensor, that the medium is supported by the platen in a case that the carriage moves in one of the first direction and the second direction to start the certain printing pass.

2. The printing apparatus according to claim 1, wherein the controller is configured to move the carriage to a facing position where the sensor faces the medium, in a case that the second distance value is equal to or less than the first distance value and that the platen supports the medium, and the controller is configured to start the certain printing pass in a case that the controller has determined, based on an output result of the sensor in a state where the carriage is in the facing position, that the platen supports the medium.

3. The printing apparatus according to claim 1, wherein the controller is configured to move the carriage in the second direction in the certain printing pass.

4. The printing apparatus according to claim 1, further comprising a conveyer configured to convey the medium in a conveyance direction, which intersects with the first direction and the second direction, while nipping the medium;

wherein the head is positioned downstream of the conveyer in the conveyance direction, the controller is configured to repeat conveyance of the medium by use of the conveyer and the printing pass corresponding to one pass, and the certain printing pass is the printing pass corresponding to one pass that is to be executed first in printing on the medium.

5. The printing apparatus according to claim 1, wherein the controller is configured to cancel printing in a case that the controller has determined, based on the output result of the sensor, that the medium is not supported by the platen in the case that the carriage moves in one of the first direction and the second direction.

6. The printing apparatus according to claim 1, further comprising an informing unit, wherein the controller is configured to cause the informing unit to inform a user of information in a case that the controller has determined, based on the output result of the sensor, that the medium is not supported by the platen in the case that the carriage moves in one of the first direction and the second direction.

7. The printing apparatus according to claim 1, wherein the printing data includes printing condition information, and the controller is configured to determine, based on the printing condition information, a nozzle that is included in the nozzles and is to be used in the certain printing pass.

8. The printing apparatus according to claim 7, wherein ink droplets of a plurality of colors are discharged, as the liquid droplets, from the nozzles, the nozzles form a plurality of nozzle groups corresponding to the plurality of colors, and ink droplets having an identical color are discharged from some of the nozzles included in each of the nozzle groups, the printing condition information is information on an ink color to be used in the certain printing pass, and the controller is configured to determine, based on the printing condition information, a nozzle group that is included in the nozzle groups corresponding to the plurality of colors and is to be used in the certain printing pass.

9. The printing apparatus according to claim 7, wherein a plurality of kinds of ink droplets are discharged, as the liquid droplets, from the nozzles, the nozzles form a plurality of nozzle groups corresponding to the plurality of kinds, and ink droplets having an identical kind are discharged from some of the nozzles included in each of the nozzle groups, the printing condition information is information on a kind of the ink droplets to be used in the certain printing pass, and the controller is configured to determine, based on the printing condition information, a nozzle group that is included in the nozzle groups corresponding to the plurality of kinds and is to be used in the certain printing pass.

10. The printing apparatus according to claim 1, wherein the sensor is an optical sensor configured to optically detect the medium.

* * * * *